US008147231B2

(12) United States Patent
Kitano et al.

(10) Patent No.: US 8,147,231 B2
(45) Date of Patent: Apr. 3, 2012

(54) SCREW COMPRESSOR HAVING ROTOR CASING WITH REMOVABLE DISCHARGE OPENING NEIGHBORHOOD PORTION

(75) Inventors: Toshiki Kitano, Takasago (JP); Yasushi Amano, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 422 days.

(21) Appl. No.: 12/464,502

(22) Filed: May 12, 2009

(65) Prior Publication Data

US 2010/0008811 A1 Jan. 14, 2010

(30) Foreign Application Priority Data

Jul. 10, 2008 (JP) ..... 2008-180499

(51) Int. Cl.
*F01C 1/16* (2006.01)
*F01C 1/24* (2006.01)
*F03C 2/00* (2006.01)

(52) U.S. Cl. ..... 418/201.1

(58) Field of Classification Search ..... 418/201.1–201.2
See application file for complete search history.

(56) References Cited

U.S. PATENT DOCUMENTS

| | | | | |
|---|---|---|---|---|
| 5,037,282 | A * | 8/1991 | Englund | 418/201.1 |
| 2002/0051722 | A1* | 5/2002 | Okada et al. | 418/201.1 |
| 2004/0001770 | A1* | 1/2004 | Khalifa et al. | 418/201.1 |
| 2004/0042921 | A1* | 3/2004 | Rousseau | 418/201.1 |

FOREIGN PATENT DOCUMENTS

| | | | |
|---|---|---|---|
| JP | 03015689 | A * | 1/1991 |
| JP | 04175488 | A * | 6/1992 |
| JP | 7-208362 | | 8/1995 |
| JP | 2000337283 | A * | 12/2000 |

* cited by examiner

*Primary Examiner* — Theresa Trieu
(74) *Attorney, Agent, or Firm* — Oblon, Spivak, McClelland, Maier & Neustadt, L.L.P.

(57) ABSTRACT

A screw compressor includes a pair of male and female screw rotors which meshes with each other, where a casing storing the pair of screw rotors is divided into a discharge opening neighborhood portion including at least a discharge opening and an other portion other than the discharge opening neighborhood portion, the discharge opening neighborhood portion is configured so as to be removable from the other portion, further, the casing is divided, by two dividing surfaces orthogonal to rotor shafts, into three portions including a rotor casing around the pair of screw rotors, a discharge casing on a side of the discharge opening, and a suction casing on a side of a suction opening, and the discharge opening neighborhood portion is formed by dividing the rotor casing, and is configured so as to be removable from the dividing surface on the side of the discharge opening of a divided rotor casing. According to this configuration, the number of man-hours required for production thereof is reduced, and if operation conditions change, the size of a discharge opening can be easily changed.

6 Claims, 5 Drawing Sheets

SCREW COMPRESSOR HAVING ROTOR CASING WITH REMOVABLE DISCHARGE OPENING NEIGHBORHOOD PORTION

BACKGROUND OF THE INVENTION

1. Field of the Invention

The present invention relates to a screw compressor which includes a pair of male and female screw rotors meshing with each other, and permits easy change of a size of a discharge opening even when operation conditions such as a compression ratio change.

2. Description of the Related Art

A performance of a screw compressor largely depends on a form (area and shape) of a discharge opening structured by an axial port (a discharge opening in the axial direction) and a radial port (a discharge opening in the radial direction). However, the size of the discharge opening of the screw compressor is usually fixed according to the operation conditions. In other words, this size of the discharge opening is determined by a design capacity ratio Vi defined by the following equation (1).

$$Vi=V1/V2 \quad (1)$$

where:

V1: maximum suction capacity of rotor grooves, and

V2: final discharge capacity of rotor grooves.

A relationship between this design capacity ratio Vi and a design pressure ratio $\dot{m}$ determined by operation conditions is represented by the following equation (2):

$$\dot{m}=P2/P1=(V1/V2)^n \quad (2)$$

where:

P1: suction pressure,

P2: final pressure in rotor grooves, and n: adiabatic exponent.

Thus, if the optimal size of the discharge opening is determined for a discharge pressure Pd such that a relationship: Pd=P2 holds, it is possible to attain maximum efficiency. Though it is desirable to determine the form of the discharge opening according to the operation conditions of the screw compressor as described above, a reduction in number of man-hours required for producing the casing has conventionally been regarded as important, and the size of the discharge opening is not changed even if the operation conditions change in some degree.

However, as a need for enhancement in performance and efficiency of screw compressors has recently been increasing, simply supplying screw compressors including a fixed discharge opening cannot meet this need, therefore, a screw compressor permitting easy change of the form of a discharge opening according to operation conditions while the number of man-hours required for producing is reduced has been sought for.

For an application of a compressor used for drawing gas from an oilfield, for example, as a result of the drawing of the reserved gas for a medium or long period, the quantity of the reserved gas decreases, and the gas pressure to be drawn therefore decreases, resulting in a large displacement in the operation conditions from initial design conditions. Since an optimal form of the discharge opening cannot be secured due to the displacements from the initial design conditions to the operation conditions, a loss in power is thus generated, and a problem of a deteriorated efficiency can occur. Moreover, a deficiency in power of a driving source may require a reproduction of an entire compressor unit. In order to cope with the problem as described above, a need is increasing for a compressor which permits easy change of the form of a discharge opening.

Under this technical background, as a conventional example, Japanese Laid-Open Patent Publication (Kokai) No. H7-208362 proposes a screw compressor in which a radial discharge port 19*a* is formed by thin casting, and a thin portion can be removed for operation at a low pressure ratio and at a high rotation speed as shown in FIG. 6. As a result, since the size of the discharge port 19*a* can be easily optimized, the same cast casing can allegedly provide a high efficiency under a wide range of operation conditions.

However, for the discharge port of the screw compressor according to the conventional example, though the number of man-hours required for production is reduced compared with that required for technologies before this conventional example, a manufacturing process for removing a thin portion (thickness: h2) of the discharge port formed by casting according to the operation conditions still needs a large load in terms of machining/production, this conventional example cannot sufficiently meet the need for a compressor permitting easy change of the size of the discharge port according to the operation conditions, while reducing the number of man-hours required for the production.

SUMMARY OF THE INVENTION

It is an object of the present invention to provide a screw compressor permitting easy change of the size of a discharge opening even if operation conditions change while the number of man-hours required for production thereof is reduced.

In order to attain the above-described object, the present invention provides a screw compressor including a pair of male and female screw rotors that meshes with each other, and a casing that stores the pair of screw rotors, where the casing is divided into a discharge opening neighborhood portion including at least a discharge opening and an other portion other than the discharge opening neighborhood portion, and is configured so that the discharge opening neighborhood portion is removable from the other portion.

According to the screw compressor configured as described above, during an operation in a medium or long period, even if operation conditions such as a suction pressure and a discharge pressure change, the discharge opening neighborhood portion can be replaced according to the operation conditions, and therefore, it is thus possible to minimize the power, and to attain energy saving. Moreover, since it is not necessary to produce an entire casing as in the conventional case, it is thus possible to reduce the time required for production, and simultaneously to reduce the cost.

In the above-described screw compressor according to the present invention, the casing may be divided, by dividing surfaces orthogonal to rotor shafts of the pair of screw rotors, into three portions including a rotor casing around the pair of screw rotors, a discharge casing on a side of the discharge opening, and a suction casing on a side of a suction opening, and the discharge opening neighborhood portion may be formed by dividing the rotor casing, and may be configured so as to be removable from the dividing surface on the side of the discharge opening of the divided rotor casing.

Moreover, in the above-described screw compressor according to the present invention, the casing may be divided, by dividing surfaces orthogonal to rotor shafts of the pair of screw rotors, into three portions including a rotor casing around the pair of screw rotors, a discharge casing on a side of the discharge opening, and a suction casing on a side of a suction opening, and the discharge opening neighborhood portion may be formed by dividing the rotor casing, a length, in a direction of the rotor shafts, of the discharge opening neighborhood portion may be approximately the same as a length, in the direction of the rotor shafts, of the divided rotor casing, and the discharge opening neighborhood portion may be configured so as to be removable from either one of the dividing surfaces on the side of the discharge opening and on the side of the suction opening of the divided rotor casing. This configuration can eliminate the necessity for changing the length of the discharge opening neighborhood portion and a fitting length of the divided rotor casing according to a compression ratio and specifications, machining applied to a fitting portion of the rotor casing can thus be unified, and the time required for the production can be reduced.

Moreover, in the above-described screw compressor according to the present invention, the casing may be divided, by a dividing surface orthogonal to rotor shafts of the pair of screw rotors, into two portions including a suction casing on a side of a suction opening, and a discharge/rotor casing on a side of the discharge opening, and around the pair of screw rotors, and the discharge opening neighborhood portion may be formed by dividing the discharge/rotor casing, a length, in a direction of the rotor shafts, of the discharge opening neighborhood portion may be approximately the same as a length of the rotor shafts, and the discharge opening neighborhood portion may be configured so as to be removable from the dividing surface on the side of the suction opening of the divided discharge/rotor casing. This configuration reduces the number of components, as well as eliminates the necessity for changing the length of the discharge opening neighborhood portion and the fitting length of the divided rotor casing according to a compression ratio and specifications. Therefore, the machining applied to a fitting portion of the rotor casing can thus be unified, and the time required for the production can be reduced.

DETAILED DESCRIPTION OF THE PREFERRED EMBODIMENTS

Figure 1:
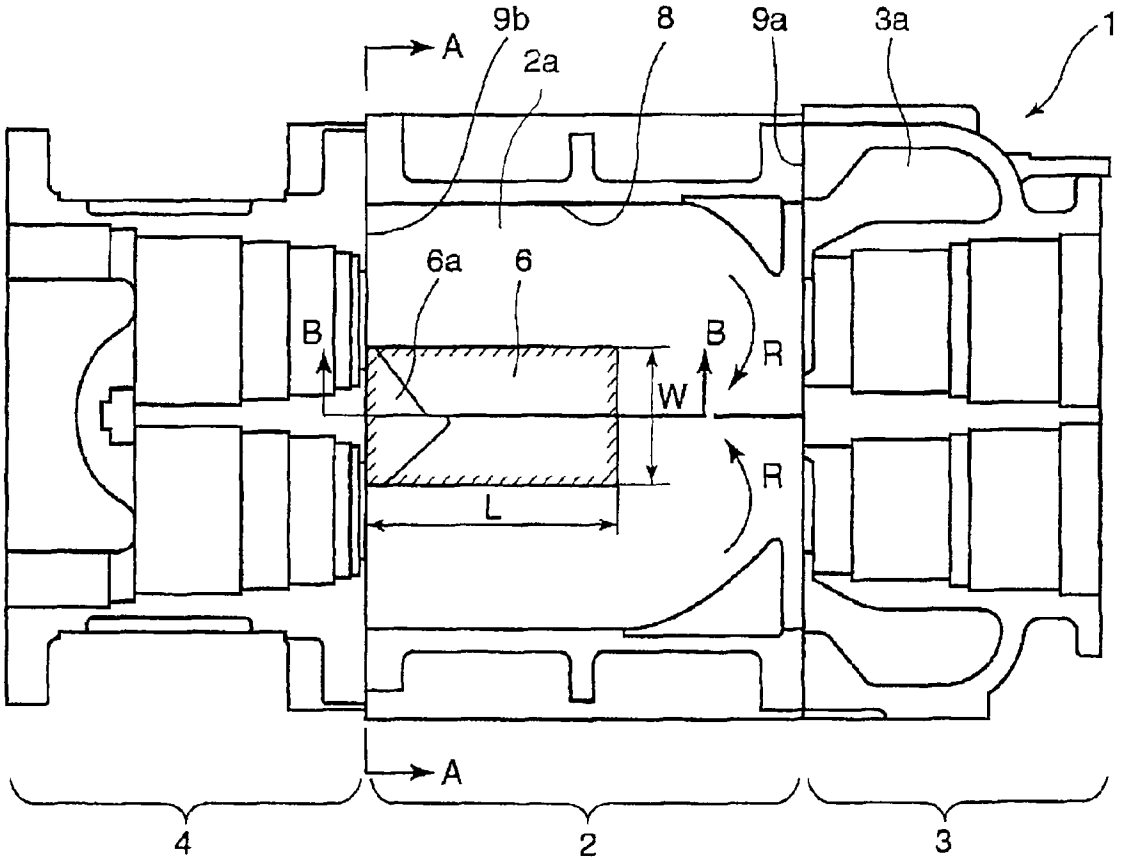
FIG. 1 shows a casing configuration of a screw compressor according to a first embodiment of the present invention, and is a horizontal cross sectional view without screw rotors, viewed along arrows C-C in FIG. 2.
Figure 2:
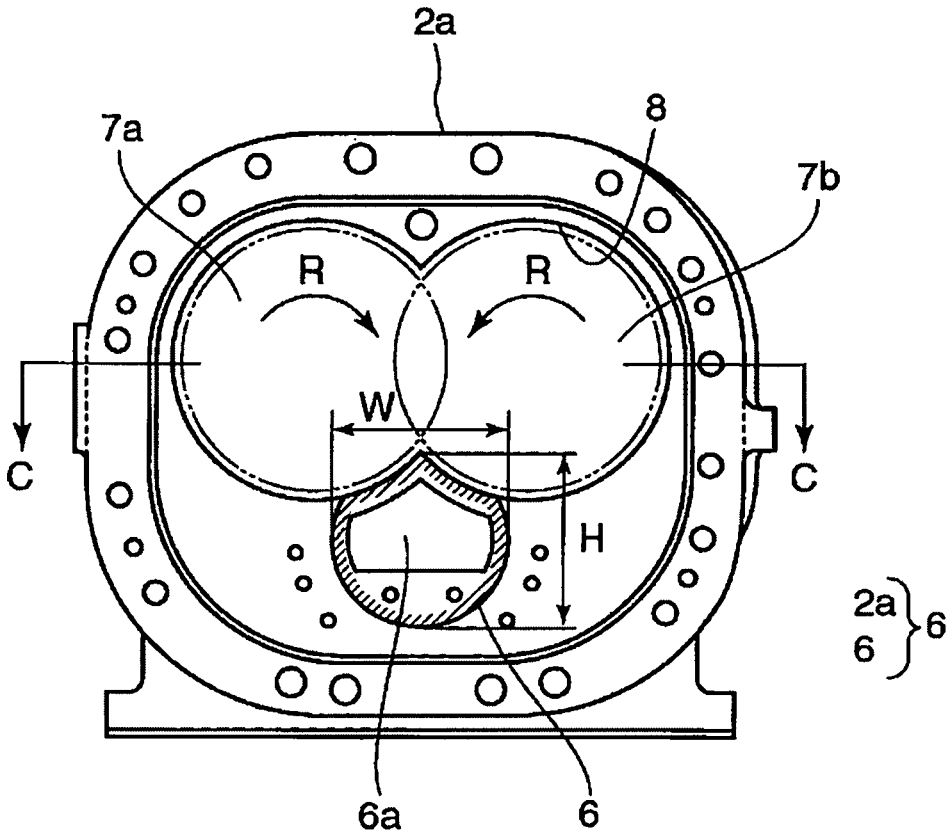
FIG. 2 is a side cross sectional view, viewed along arrows A-A in FIG. 1.
Figure 3:
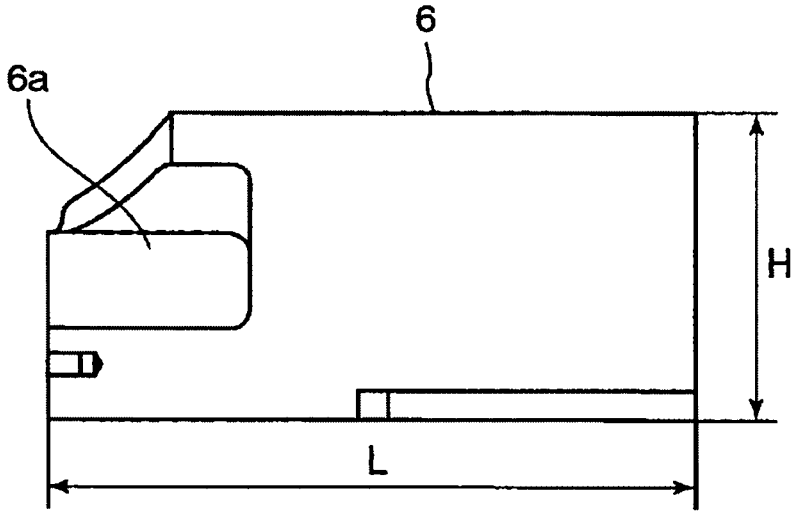
FIG. 3 is an enlarged cross sectional view, viewed along arrows B-B in FIG. 1.

First, a description will now be given to a screw compressor according to a first embodiment of the present invention with reference to FIGS. 1 to 3. FIG. 1 shows a casing configuration of the screw compressor according to the first embodiment of the present invention, and is a horizontal cross sectional view without screw rotors, viewed along arrows C-C in FIG. 2. FIG. 2 is a side cross sectional view, viewed along arrows A-A in FIG. 1. FIG. 3 is an enlarged cross sectional view, viewed along arrows B-B in FIG. 1.

With respect to the screw compressor according to the first embodiment of the present invention, a pair of male and female screw rotors 7*a* and 7*b* meshes with each other, and are rotatably stored in a rotor chamber 8 formed inside a rotor casing 2 as shown in FIG. 2. Then, only one of the pair of male and female screw rotors 7*a* and 7*b*, namely the male rotor 7*a* is connected to a driving shaft of a driving motor, which is not shown.

The female rotor 7*b* is driven by the male rotor 7*a*, and a compression space is formed in a gap between these male rotor 7*a* and the female rotor 7*b*, the screw rotors 7*a* and 7*b* are rotated by the driving motor in a rotation direction indicated by arrows R in FIG. 2, thereby sucking a gas supplied from a suction flow passage which is not shown, from a suction opening 3*a* of the screw rotors 7*a* and 7*b* of the compressor, compressing the gas, and discharging the compressed gas as a high pressure fluid from a discharge opening 6*a* of the screw rotors 7*a* and 7*b* to a discharge flow passage which is not shown.

In the screw compressor according to the first embodiment of the present invention, the casing 1 of the screw compressor is divided into three portions including the rotor casing 2, a suction casing 3 on the suction opening 3*a* side, and a discharge casing 4 on the discharge opening 6*a* side. A dividing surface 9*a* on the suction opening 3*a* side which divides the suction casing 3 and the rotor casing 2 from each other is formed so as to include a surface opposed to a rotor right end surface in a rotor chamber 8 (surface forming the suction opening 3*a* leading into the rotor chamber 8) in FIG. 1, and a dividing surface 9*b* on the discharge opening 6*a* side which divides the discharge casing 4 and the rotor casing 2 from each other is formed so as to include a surface opposed to a rotor left end surface in the rotor chamber 8 (surface forming the discharge opening 6*a* leading out from the rotor chamber 8) in FIG. 1.

Further, a discharge opening neighborhood portion 6 including at least the discharge opening 6*a* is formed by dividing a part of the rotor casing 2, and is configured so as to be removable from the dividing surface 9*b* on the discharge opening 6*a* side of the remaining divided rotor casing 2*a*. Then, an other portion is constituted by the suction casing 3, the discharge casing 4, and the remaining dividing rotor casing 2*a*. In order to fix the discharge opening neighborhood portion 6 to the other portion, there may apply such a configuration that the respective portions have flange portions which are not shown, and these flange portions are screwed to each other, for example.

The size of the discharge opening neighborhood portion 6 may have a length L, a width W, and a height H, which are respectively the maximum depth or more, the maximum width or more, and the maximum height or more for possibly forming the discharge opening 6*a*. Moreover, it is not necessary to cut out the discharge opening neighborhood portion 6 from a part of the integrally-formed rotor casing 2 for forming it, and it is possible to form the discharge opening neighborhood portion 6 and the remaining divided rotor casing 2*a* separately from each other in advance. When the discharge opening neighborhood portion 6 and the remaining rotor casing 2*a* are formed separately from each other, it is preferable to use the same material for forming both of them in consideration of a uniform thermal expansion coefficient.

With this configuration, the discharge opening neighborhood portion 6 having the discharge opening 6*a* optimized (optimized in terms of the size of an opening area of the discharge opening 6*a*, for example) according to changes in operation conditions such as the suction pressure and the discharge pressure, is produced, and is configured so as to be removable from the rotor casing 2*a* of the other portion. As a result, since the discharge opening neighborhood portion 6 can be replaced according to the operation conditions during an operation for a medium or long period, it is possible to minimize the power and to attain energy saving. Moreover, since it is not necessary to produce an entire casing as in the conventional case, it is thus possible to reduce the time required for production, and simultaneously to reduce the cost.

Figure 4:
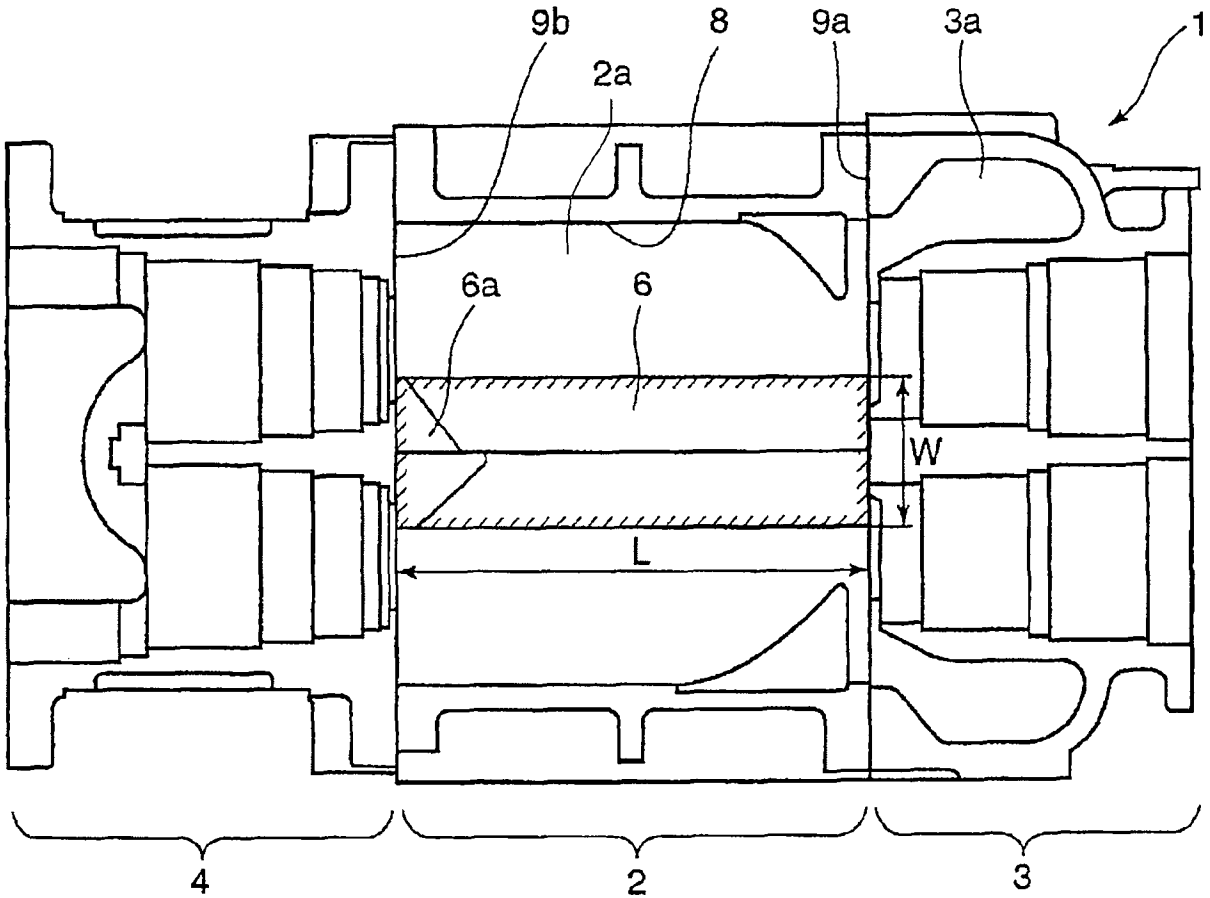
FIG. 4 shows a casing configuration of the screw compressor according to a second embodiment of the present invention, and is a horizontal cross sectional view without screw rotors, viewed along arrows similarly to FIG. 1.

A description will now be given to the screw compressor according to a second embodiment of the present invention with reference to FIG. 4. FIG. 4 shows a casing configuration of the screw compressor according to the second embodiment of the present invention, and is a horizontal cross sectional view without screw rotors, viewed along arrows similarly to FIG. 1. The second embodiment of the present invention is different from the first embodiment in a configuration of the discharge opening neighborhood portion, and the other configuration is exactly the same as that of the first embodiment, and a description will only be given to the configuration of the discharge opening neighborhood portion.

In other words, the discharge opening neighborhood portion 6 according to the first embodiment is formed in the rotor shaft direction from the dividing surface 9*b* of the rotor casing 2, as the portion having the predetermined length L shorter than the length of the divided rotor casing 2*a*.

On the other hand, according to the second embodiment of the present invention, the discharge opening neighborhood portion 6 is formed as a fitting portion which has the length L in the rotor shaft direction, and passes through the rotor casing 2 from the dividing surface 9*b* to the dividing surface 9*a*. Then, the discharge opening neighborhood portion 6 is configured so as to be removable either from the dividing surface 9*a* on the suction opening 3*a* side and the dividing surface 9*b* on the discharge opening 6*a* side of the divided rotor casing 2.

Since the screw compressor according to the second embodiment of the present invention is formed as described above, it is not necessary to change the length L of the discharge opening neighborhood portion 6 according to the compression ratio or specifications, and the machining of the discharge opening neighborhood portion 6 in the rotor casing 2 can be unified, resulting in a reduction in period required for the production. Moreover, since the discharge opening neighborhood portion 6 is removable either from the suction opening 3*a* side and the discharge opening 6*a* side of the rotor casing 2, it is possible to properly select a method or the direction for the removal according to devices around the casing 1 and a configuration of piping or the like.

Figure 5:
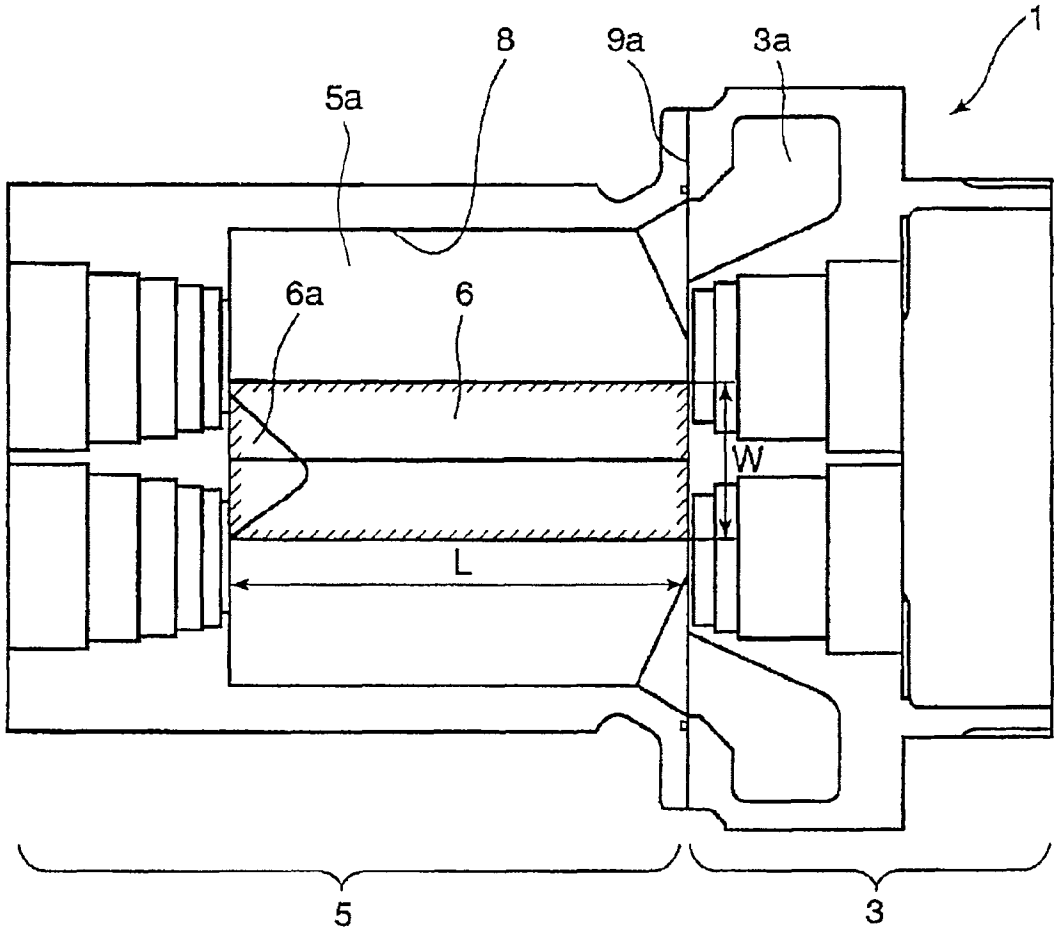
FIG. 5 shows a casing configuration of the screw compressor according to a third embodiment of the present invention, and is a horizontal cross sectional view without screw rotors, viewed along arrows similarly to FIG. 1.
Figure 6:
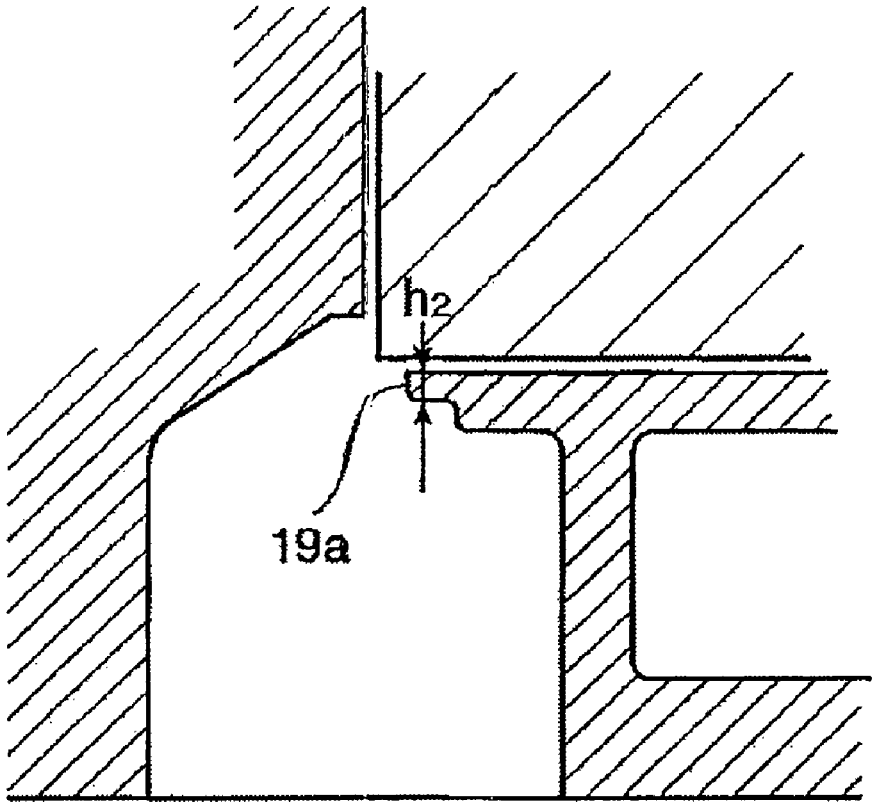
FIG. 6 PRIOR ART
FIG. 6 describes a discharge port of a screw compressor according to a conventional example.

A description will now be given to the screw compressor according to a third embodiment of the present invention with reference to FIG. 5. FIG. 5 shows a casing configuration of the screw compressor according to the third embodiment of the present invention, and is a horizontal cross sectional view without screw rotors, viewed along arrows similar to FIG. 1. The third embodiment of the present invention is different from the first embodiment in a division configuration of the casing, and a configuration of the discharge opening neighborhood portion, and the other configuration is exactly the same as that of the first embodiment, and therefore, a description will only be given to the division configuration of the casing, and the configuration of the discharge opening neighborhood portion.

In other words, according to the first embodiment of the present invention, the casing 1 is divided, by the dividing surfaces 9*a* and 9*b* which are orthogonal to the rotor shafts, into three portions including the suction casing 3 on the suction opening 3*a* side, the rotor casing 2, and the discharge casing 4 on the discharge opening 6*a* side, and the discharge opening neighborhood portion 6 is configured in the rotor shaft direction from the dividing surface 9*b* of the rotor casing 2, as the portion having the predetermined length L shorter than the length of the divided rotor casing 2*a*.

On the other hand, according to the third embodiment of the present invention, the casing 1 is divided by the dividing surface 9*a* orthogonal to the rotor shafts into two portions including the suction casing 3 on the suction opening 3*a* side and a discharge/rotor casing 5 on the discharge opening 6*a* side and around the screw rotors, while the discharge opening neighborhood portion 6 is formed by dividing the discharge/rotor casing 5, and the discharge opening neighborhood portion 6 is configured to have the length L in the rotor shaft direction as long as the rotor length. Then, the discharge opening neighborhood portion 6 is configured so as to be removable from the dividing surface 9*a* on the suction opening 3*a* side of a divided discharge/rotor casing 5*a*.

Since the screw compressor according to the third embodiment of the present invention is configured as described above, the number of components is reduced compared with that of the second embodiment, and it is not necessary to change the length L of the discharge opening neighborhood portion 6 and a fitting length of the divided discharge/rotor casing 5*a* according to the compression ratio or specifications. Therefore, the machining of the discharge opening neighborhood portion 6 and the fitting portion of the divided discharge/rotor casing 5*a* can be unified, resulting in a reduction in period required for the production.

It should be noted that especially many conventional oilless screw compressor originally have a casing divided into two potions including a suction casing and a discharge/rotor casing as described above. Thus, it is possible, by machining the casing of the conventional oilless screw compressor, to convert it into the casing 1 (the suction casing 3 and the discharge/rotor casing 5) of the screw compressor according to the third embodiment of the present invention.

As described above, in the screw compressors according to the present invention, the casing storing the screw rotors is divided into the discharge opening neighborhood portion including at least the discharge opening, and the other portion other than the discharge opening neighborhood portion. And the discharge opening neighborhood portion is configured so as to be removable from the other portion. Therefore, even if operation conditions such as the suction pressure or the discharge pressure are changed during an operation in a medium and long period, it is possible to replace the discharge opening neighborhood portion according to the operation conditions, and thus it is possible to minimize the power and to attain the energy saving. Moreover, since it is not necessary to produce an entire casing as in the conventional case, it is thus possible to reduce the time required for production, and simultaneously the cost.

What is claimed is:

1. A screw compressor comprising:

a pair of male and female screw rotors that mesh with each other; and a compressor casing that stores said pair of screw rotors, wherein the compressor casing is divided, by dividing surfaces orthogonal to rotor shafts of said pair of screw rotors, into a rotor casing around said pair of screw rotors, a discharge casing on a side of a discharge opening, and a suction casing on a side of a suction opening, wherein said rotor casing is divided into a discharge opening neighborhood portion comprising at least said discharge opening, and a remaining rotor casing portion other than said discharge opening neighborhood portion, and is configured so that said discharge opening neighborhood portion of said rotor casing is removable from said remaining rotor casing portion of said rotor casing, whereby said suction casing and said discharge casing need not be replaced when the performance of the screw compressor is changed.

2. The screw compressor according to claim 1, wherein:

said discharge opening neighborhood portion is removable from said dividing surface on the side of said discharge opening of said rotor casing.

3. The screw compressor according to claim 1, wherein:

a length, in a direction of said rotor shafts, of said discharge opening neighborhood portion is approximately the same as a length, in the direction of said rotor shafts, of said rotor casing, and said discharge opening neighborhood portion is configured so as to be removable from either one of said dividing surfaces on the side of said discharge opening and on the side of said suction opening of said rotor casing.

4. The screw compressor according to claim 1, wherein:

a length, in a direction of said rotor shafts, of said discharge opening neighborhood portion is approximately the same as a length of said rotors, and said discharge opening neighborhood portion is configured so as to be removable from said dividing surface on the side of said suction opening of said rotor casing.

5. The screw compressor according to claim 1, wherein said rotor casing is configured so that said discharge opening neighborhood portion is removable from said remaining rotor casing portion at least one of the dividing surfaces and in the direction of the rotational axis of the pair of screw rotors.

6. A screw compressor comprising:

a pair of male and female screw rotors that mesh with each other; and a compressor casing that stores said pair of screw rotors, wherein the compressor casing is divided, by a dividing surface orthogonal to rotor shafts of said pair of screw rotors, into a discharge side rotor casing around said pair of screw rotors and on a side of a discharge opening, and a suction casing on a side of a suction opening, wherein said rotor casing is divided into a discharge opening neighborhood portion comprising at least said discharge opening, and a remaining rotor discharge side casing portion other than said discharge opening neighborhood portion, and is configured so that said discharge opening neighborhood portion of said discharge side rotor casing is removable from said remaining discharge side rotor casing portion of said discharge side rotor casing, whereby said suction casing need not be replaced when the performance of the screw compressor is changed, wherein a length, in a direction of said rotor shafts, of said discharge opening neighborhood portion is approximately the same as a length of said pair of screw rotors, and said discharge opening neighborhood portion is configured so as to be removable from said dividing surface on the side of said suction opening of said divided discharge side rotor casing.

* * * * *